US005401383A

United States Patent [19]

Ewener

[11] Patent Number: 5,401,383

[45] Date of Patent: Mar. 28, 1995

[54] CONTROLLING CHILLING TOWER PROFILE FOR DILUTION CHILLING DEWAXING OF 600N WAXY OIL

[75] Inventor: Patrick C. Ewener, Sarnia, Canada

[73] Assignee: Exxon Research & Engineering Co., Florham Park, N.J.

[21] Appl. No.: 119,771

[22] Filed: Sep. 10, 1993

[51] Int. Cl.[6] ..... C10G 43/08

[52] U.S. Cl. ..... 208/33; 208/37; 208/38

[58] Field of Search ..... 208/33, 37, 38, 35

[56] References Cited

U.S. PATENT DOCUMENTS

| | | | |
|---|---|---|---|
| 3,642,609 | 2/1972 | Mayer et al. | 208/37 |
| 3,681,230 | 8/1972 | Eagen et al. | 208/33 |
| 3,773,650 | 11/1973 | Hislop et al. | 208/33 |
| 3,775,288 | 11/1973 | Eagen et al. | 208/33 |
| 3,779,894 | 12/1973 | Eagen et al. | 208/33 |
| 3,850,740 | 11/1974 | Gudelis et al. | 208/33 |
| 4,115,243 | 9/1978 | Harrison | 208/33 |
| 4,115,244 | 9/1978 | Pitman et al. | 208/33 |
| 4,115,245 | 9/1978 | Harrison et al. | 208/33 |
| 4,146,461 | 3/1979 | Broadhurst et al. | 208/33 |
| 4,216,075 | 8/1980 | Ryan | 208/35 |
| 4,319,962 | 3/1982 | Ryan | 196/14.5 |

FOREIGN PATENT DOCUMENTS

| | | | |
|---|---|---|---|
| 348044 | 12/1989 | European Pat. Off. | C10G 73/34 |
| 264227 | 1/1989 | Germany | C10G 73/34 |
| 1437384 | 11/1988 | U.S.S.R. | C10G 73/32 |

OTHER PUBLICATIONS

"Dewaxing of a heavy paraffinic oil in a solution of dimethylformamide and toluene" Kakkos, et al, Neft. Gezov Prom-st 1989 (3) 52-4. Abstract.

"Dewaxing of a middle paraffinic distillate from the Drogabych Petroleum Refinery" Kakkos et al, Neft Gazov Prom-st, 1991 (2) 51-3. Abstract.

"Factors influencing the filtration rate in solvent-wax removal" Isoya. Idemitsu Giho 1992 35(4) 395-400 Abstract.

"Low Temperature Ketone Dewaxing of Mineral Oils by Direct Cooling" Passut et al. Ind. Eng. Chem Process Des Div. vol. 16, No. 1, 1977 120-124.

"Encyclopedia of Chemical Processing & Design—Dewaxing, Solvent" vol. 15 pp. 353-370, 1982.

"Paraffin wax bulk crystallization From solution" Menshov et al. Teor. Osn. Khim Tekknol, 1987 21(4) 549-52.

*Primary Examiner*—Helane Myers

*Attorney, Agent, or Firm*—Joseph J. Allocca

[57] ABSTRACT

The incremental solvent dilution chilling of 600N waxy oils in a staged agitated chilling tower using cold solvent injection is improved in terms of feed filter rate with respect to a 600N waxy oil having a final boiling point of >600° C. and a mean boiling point of about 500° C. when the solvent dewaxing process is practiced under conditions of cold solvent injection such that there is an equal chilling rate/stage profile as compared to an equal temperature drop/stage profile in the chilling tower and with respect to a 600N waxy oil having a final boiling point of 600° C. and a mean boiling point of about 500° C. when the solvent dewaxing process is practiced under conditions of cold solvent injection such that there is an equal temperature drop/stage profile as compared to an equal chilling rate/stage profile in the chilling tower.

9 Claims, 2 Drawing Sheets

CONTROLLING CHILLING TOWER PROFILE FOR DILUTION CHILLING DEWAXING OF 600N WAXY OIL

BACKGROUND OF THE INVENTION

1. Field of the Invention

This invention relates to a process for solvent dewaxing waxy hydrocarbon oils. More particularly, this invention relates to an improved process for dilution chilling dewaxing waxy hydrocarbon oil stocks in a staged chilling zone wherein cold dewaxing solvent is injected into said zone at a plurality of stages therealong and wherein the cold dewaxing solvent and the waxy oil are substantially instantaneously mixed in each stage as the waxy oil-solvent mixture passes from stage to stage, the improvement comprising adjusting the temperature profile along said zone such that when the waxy feed stock is a 600N waxy oil having a final boiling point of >600° C., preferably >605° C., most preferably >610° C. and a mean boiling point of about 490°-510° C., preferably about 500° C. there is an equal chilling rate/stage profile as compared to an equal temperature drop profile in the staged chilling zone and when the waxy feed stock is a 600N waxy oil having a final boiling point <600° C., preferably <595° C., most preferably <590° C. and a mean boiling point of about 490°-510° C., preferably about 500° C. there is an equal temperature drop/stage profile as compared to an equal chilling rate/stage profile in the staged chilling zone. The improvement is evidenced by increased feed filter rate.

2. Description of the Prior Art

It is well known that wax-containing petroleum oil stocks can be dewaxed by shock chilling with a cold solvent. It is also known that shock chilling, in itself, results in a low filtration rate of the dewaxed oil from the resultant wax/oil-solvent slurry. It is now well known that the harmful effects of shock chilling can be overcome by introducing the waxy oil into a staged chilling zone and passing the waxy oil from stage to stage of the zone, while at the same time injecting cold dewaxing solvent into a plurality of the stages and wherein a high degree of agitation is maintained in the stages so as to effect substantially instantaneous mixing of the waxy oil and solvent. As the waxy oil passes from stage to stage of the cooling zone it is cooled to a temperature sufficiently low to precipitate wax therefrom without incurring the harmful effects of shock chilling. This technique produces a wax/oil-solvent slurry wherein the wax particles have a unique crystal structure which provides superior filtering characteristics such as high filter rates and high dewaxed oil yields. The basic concept of dilution chilling dewaxing is disclosed in U.S. Pat. No. 3,773,650, the disclosures of which are incorporated herein by reference and will hereinafter be referred to as DILCHILL* for the sake of brevity. (*DILCHILL is a registered Service Mark of Exxon Research and Engineering Company).

A number of improvements and modifications have been made to the basic concept of DILCHILL. U.S. Pat. No. 3,642,609 shows that in a vertically staged cooling tower, the velocity of the solvent at the injection points within each stage should be at least 5-30 times that of the peripheral velocity of the mixer blades. This results in greater filtration rates and higher dewaxed oil yields than could otherwise be obtained without the relatively high velocity solvent injection. In U.S. Pat. No. 3,775,288 is disclosed a combination of dilution chilling with scraped surface chilling for dewaxing lubricating oils. U.S. Pat. No. 3,681,230 discloses adjusting the dewaxing solvent composition so that the waxy oil and solvent are immiscible near the last stage of the cooling zone. This results in superior dewaxed oil yields and higher filter rates when the waxy oil stock being fed to the tower is relatively high in viscosity and molecular weight. U.S. Pat. No. 3,850,740 discloses partially prediluting the waxy oil when same is relatively heavy feed such as a resid or a bright stock, before the oil is introduced into the chilling zone.

However, in all of these DILCHILL dewaxing processes it was thought that the rate of solvent addition to each stage should be adjusted so as to obtain the same or approximately equal temperature drops in each stage. For example, U.S. Pat. No. 3,773,650 in column 6, lines 7-11, discloses adding cold solvent so as to give equivalent temperature drops per stage. Similarly, in U.S. Pat. No. 3,775,288 at column 4, lines 38-43, it is disclosed that the same temperature drop should be maintained from stage to stage of the chilling zone.

U.S. Pat. No. 4,146,461 shows that the DILCHILL process is improved when the waxy lube oil stocks are solvent dewaxed by contacting them with successive increments of cold dewaxing solvent at a plurality of points along the height of a vertical tower divided into a plurality of stages while agitating the oil solvent mixture in each stage to provide substantially instantaneous mixing of the waxy oil and solvent thereby precipitating wax from the oil while avoiding the well known shock chilling effect by adjusting the cold solvent addition to each stage in a manner so as to modify the temperature profile along the tower to ensure that the temperature drop per stage in the initial stages in which wax precipitation occurs is greater than the temperature drop per stage in the final or later stages in which wax precipitation occurs.

THE PRESENT INVENTION

Figure 1:
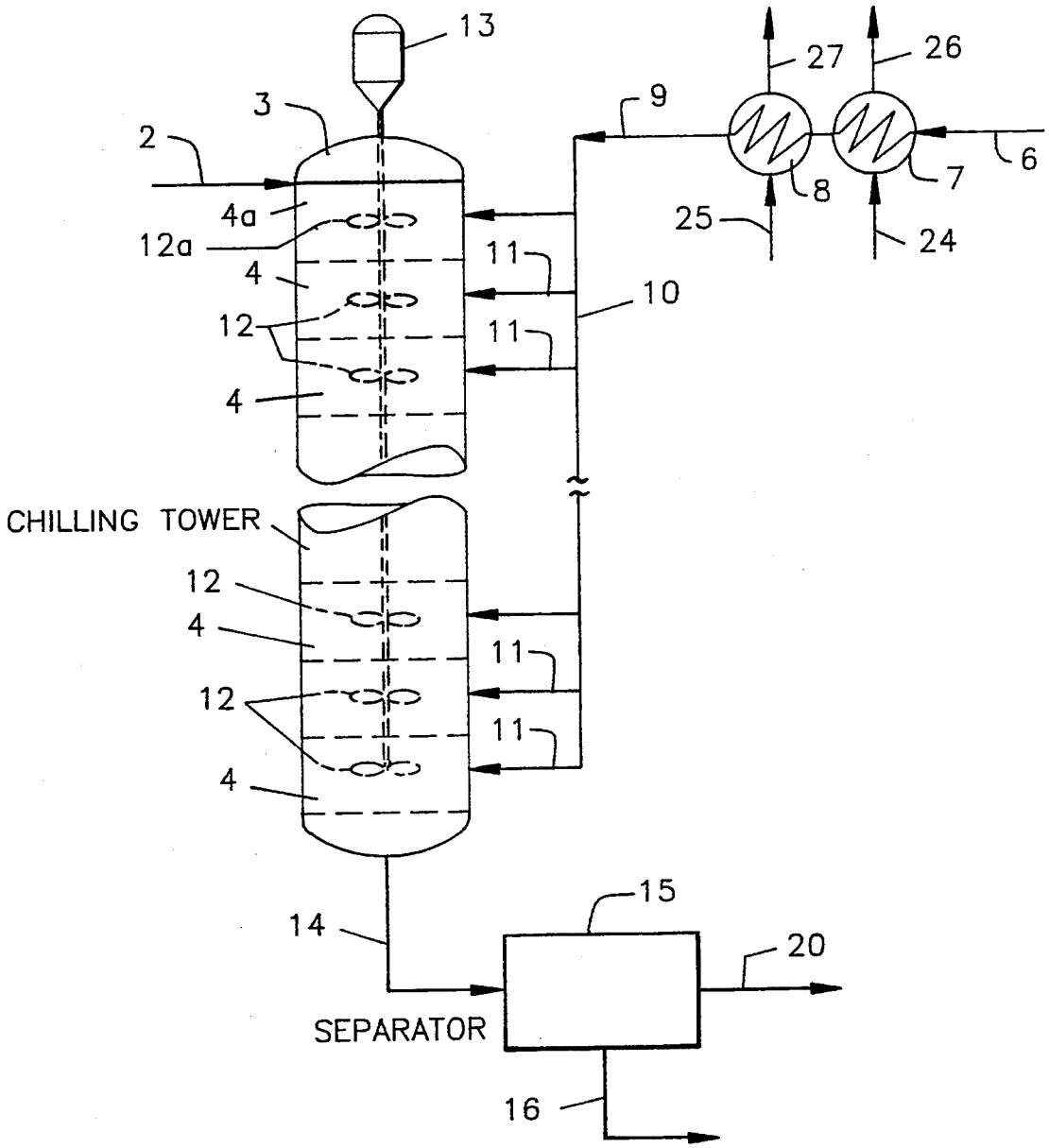
FIG. 1 is a schematic of an incremental cold solvent injection agitated dewaxing chilling tower.

It has been discovered that incremental solvent dilution chilling of 600N waxy oils in a staged agitated chilling tower is improved in terms of feed filter rate when the chilling profile in the tower is adjusted in response to the particular feed being dewaxed based on feed final boiling point. Therefore, in a process for dewaxing 600N waxy oil comprising introducing said waxy oil stock into an elongated preferably vertical, chilling zone divided into a plurality of stages and passing said waxy oil from stage to stage of said chilling zone while injecting cold dewaxing solvent into at least a portion of said stages and maintaining a high degree of agitation in a plurality of the solvent-containing stages so as to achieve substantially instantaneous mixing of said waxy oil and said cold solvent thereby cooling said solvent-waxy oil mixture as it progresses from stage to stage through said chilling zone and thereby precipitating at least a portion of said wax from said oil under conditions of said high degree of agitation, separating the precipitated wax from the solvent-oil mixture and recovering a petroleum oil stock of reduced wax content from said mixture wherein the feed filter rate of a 600N waxy feed having a final boiling point of >600° C. and a mean boiling point of about 500° C. is improved when the solvent dewaxing process is practiced under conditions such that there is an equal chilling rate/stage profile as compared to an equal temperature drop/stage profile in the chilling tower and wherein the feed filter rate of a 600N waxy feed having a final boiling <600° C. and a mean boiling point of about 500° C. is improved when the solvent dewaxing process is practiced under conditions such that there is an equal temperature drop/stage profile as compared to an equal chilling rate/stage profile in the chilling tower.

The waxy oil being dewaxed is a 600N oil. This oil is typically characterized by having a viscosity of about 55 to 65 SSU @100° C., preferably about 60 SSU @100° C., a Viscosity Index of about 85 to 99, preferably about 92 and contains about 14 to 24 wt % wax, preferably about 18 wt % wax at a filtration temperature of −10° C. The oil has a cloud point of about +50° to +56° C., preferably about +53° C.

Preferably, the waxy oil is a solvent extracted 600N oil raffinate derived from any source such as the crudes obtained from Saudi Arabia, Kuwait, the Panhandle, North Louisiana, Coastal crudes, Tia Juana, North Sea, Brent as well as synthetic feedstocks derived from tar sands, shale, coal, etc. as well as through hydrocarbon synthesis such as CO hydrogenation (e.g. Fischer Tropsch). Solvent extraction is practiced using aromatics selective solvents such as furfural, phenol, sulfolane, n-methyl pyrrolidone, $SO_2$ etc to reduce the aromatics content of the oil.

The 600N oil is divided into two distinct categories; 600N oil having a final boiling point of >600° C., preferably >605° C. and a 600N oil having a final boiling point of <600° C., preferably <595° C.

Any solvent useful for dewaxing waxy petroleum oils may be used in the process of this invention. Representative examples of such solvents are (a) the aliphatic ketones having from 3–6 carbon atoms, such as acetone, methylethyl ketone (MEK) and the methyl isobutyl ketone (MIBK) and (b) the low molecular weight autorefrigerant hydrocarbons, such as ethane, propane, butane and propylene, as well as mixtures of the foregoing and mixtures of the aforesaid ketones and/or hydrocarbons with aromatic compounds, such as benzene, xylene and toluene. In addition, halogenated, low molecular weight hydrocarbons, such as $C_2$–$C_4$ chlorinated hydrocarbons (e.g., dichloromethane, dichloroethane, methylene chloride) and mixtures thereof may be used as solvents. Specific examples of suitable solvent mixtures are methylethyl ketone and methyl isobutyl ketone, methylethyl ketone and toluene, dichloromethane and dichloroethane, propylene and acetone. Preferred solvents are ketones.

The mechanics of the incremental cold solvent injection agitated chilling process is described by reference to FIG. 1.

The oil stock to be dewaxed, at a temperature slightly above its cloud point, is passed into the top of vertical DILCHILL chilling tower 3 via line 2 wherein it enters the first stage of the chiller 4(*a*). The solvent selected for dewaxing the oil stock is passed through heat exchangers 7 and 8 via line 6 wherein the solvent temperature is reduced to a level sufficient to cool the oil to the desired dewaxing temperature. Coolant enters heat exchanges 7 and 8 through lines 24 and 25, respectively, and leaves through lines 26 and 27. Cold solvent leaves heat exchange 8 via line 9 and enters manifold 10. The manifold comprises a series of parallel lines providing solvent inlets 11 to the plurality of stages 4 of chilling tower 3. The rate of flow through each inlet is regulated by flow control means (not shown). The rate of solvent flow is regulated so as to maintain the desired temperature profile distribution from stage to stage along the height of chilling tower 3.

In general, the amount of solvent added thereto will be sufficient to provide a liquid/solid weight ratio between about 5/1 and 100/1 at the dewaxing temperature and a solvent/oil volume ratio between about 1.0/1 and 7/1.

The first portion or increment of cold dewaxing solvent enters the first stage, 4(*a*), of chilling tower 3 wherein it is substantially instantaneously mixed with the oil due to the action of agitator 12(*a*). The agitator is driven by a variable speed motor 13 and the degree of agitation is controlled by a variation of the motor speed with due allowance for the flow rate through the cooling tower. Although only downward flow rate of the oil-solvent mixture through chilling tower 3 has been shown, this mixture may also pass upwardly through the tower, in which case the first and last stages will occur near the bottom and top of the tower, respectively. Additional prechilled solvent is introduced into at least a portion of the plurality of stages 4, through inlets 11, so as to achieve the desired temperature profile in the tower and at the same time to provide the desired degree of dilution. It should be noted that any number of stages, for example 50, may be employed; however, it is desirable that at least six stages be used. For most applications the number of stages will range between 10 and 20.

The oil-solvent mixture with precipitated wax passes from the final stage of the chilling tower through line 14 to means for separating the wax from said solution 15. Any suitable means, for such separation may be employed, such as filtration or centrifugation. In general, filtration is a preferred means of separation. The oil-solvent mixture leaves wax separation means 15 via line 20 and is sent to further processing such as solvent recovery to recover the solvent therefrom. The wax leaves separation zone 15 via line 16 and then passes through additional refining and solvent recovery operations.

An essential feature of this invention is the maintenance of a high degree of agitation in all stages into which cold dewaxing solvent is injected and in which wax precipitation occurs. In general, the degree of agitation must be sufficient to provide substantially instantaneous mixing, i.e., substantially complete mixing of the oil-solvent mixture in one second or less. In this way, the deleterious effects of shock chilling are avoided and increased filtration rates are obtained. The degree of agitation required in this invention can be achieved by increasing the agitator RPM when all other mixing variables; e.g., flow rate through the mixer, vessel and agitator design, viscosity of the ingredients, etc., are maintained constant. In general, the degree of agitation required in this invention can be achieved when the modified Reynolds Number (Perry, "Chemical Engineer's Handbook," 3rd, p. 1224, McGraw-Hill, New York, 1959), $N_Re$, which is defined by the equation:

$$N_Re = L^2 nl/\mu$$

where

L=agitator diameter, feet l=liquid density, pound/feet$^3$ n=agitator speed, revolution/second $\mu$=liquid viscosity, pound/feet second ranges between about 200 and about 150,000. The dimensionless ratio of chilling tower diameter to agitator diameter is between about 1.5/1 and about 10/1 and the ratio of the impeller blade length to impeller blade width ranges from about 0.75 to 2 and preferably from about 1 to 1.5. The ratio of the mixing stage height to the diameter of the stage will generally range from about 0.2/1 to about 1/1. A turbine type agitator is preferred, however, other types of agitators such as propellers may be used.

The chilling tower may or may not be baffled, but a baffled tower is preferred. Each stage will generally contain from about 2–8 baffles and preferably from 2–4 baffles located about the outer periphery of each stage. The width of the baffles may range from about 5–15% of the diameter of the tower. In general, the dimensionless ratio of the cross-section of the restricted flow opening between stages to the cross-section of the tower will be between about 1/10 and about 1/200.

In general, the chilling tower of the present invention will be operated at a pressure sufficient to prevent flashing of the solvent. Atmospheric pressure is sufficient when the ketones are employed as solvents; however, superatmospheric pressures are required when low molecular weight, autorefrigerant hydrocarbons, such as propane, are used. In some cases it is more advantageous to operate the tower under elevated pressure, even when the dewaxing solvent does not contain an autorefrigerant, in order to provide flow of the waxy oil-solvent slurry to an elevated location and/or wax filters, etc., without having to pump the slurry.

As has been stated, the dewaxing process is improved when there is either an equal chilling rate/stage or an equal temperature drop/stage profile in the chilling tower, depending on whether the 600N oil has a final boiling point <600° C. or >600° C. This chiller profile is controlled by adjusting the volume of cold dilution solvent going to each stage. Plotting chilling range vs stage number will give a straight line for the equal temperature drop/stage profile and a concave curve for the equal chilling rate/stage profile. When it is desired that the process is controlled so that an equal chilling rate/stage is achieved, a chilling rate in the range of from about 1° to 3° C./stage, preferably about 1.5° C./stage is selected whereas when it is desired that the process is controlled so that an equal temperature drop/stage is achieved, a temperature drop per stage in the range of about 2° to 5° C./stage, preferably about 3.5° C./stage is selected.

EXAMPLE

A 600N raffinate feed having a final boiling point of 596° C. was used as a standard feed. This standard feed was used to prepare comparative samples of 600N feed having higher final boiling points by the addition of 2.5, 5/0 and 10.0% of a higher boiling oil fraction an 1800N oil which has a mean boiling point of 550° C. and a final boiling point of 668° C.

The samples were run in a lab unit using standard lab conditions and the results at equal chilling rate (=CR) and equal temperature drop (=DT) were recorded and compared.

The examples were run utilizing a single stage cold solvent injection agitated dewaxing laboratory scale batch unit. While not completely duplicating continuous multi-stage operations, the lab batch unit has been found to give results approximately equivalent to those obtained with continuous, commercial multi-stage operations.

The lab unit was a sealed 6 inch diameter pipe 3 inches high containing a flat blade turbine agitator about 5 cm in diameter, a solvent injection tube, and three ½ inch wall baffles. The unit was filled with the waxy oil at a temperature ~3 C. above its cloud point and the turbine was started at a speed of ~1140 rpm. Cold (−29 C.) solvent (30/70, LV %, MEK/MIBK) was added in increments to simulate the 17 individual stages of a commercial unit calculated to give a final dilution of solvent/waxy feed of 3/1, v/v. The volume of solvent to be added to each stage was predetermined so as to produce a temperature profile which was characterized by: 1. an equal chilling rate in each of the 17 stages (=CR profile) or 2. an equal temperature drop in each of the 17 stages (=DT profile). These run programs are presented in Table 1A and 1B.

The resultant slurries were chilled in simulated scraped surface exchanger (dash pot) at a rate of ~1 to 2 C./min to the filtration temperature of −10 C. Timed filtration and mass balance of recovered wax, oil, and solvent were used to measure FFR (feed filter rate) and L/S (wax cake liquids/solids). Lower L/S ratios is taken as an indication of the amount of oil retained in the wax cake which is interpreted as higher dewaxed oil yield.

TABLE 1A

| | Equal Temperature Drop/Stage | | | | | | |
|---|---|---|---|---|---|---|---|
| Stage | Stage Temp °C. | Volume Out of Stage CM3 | Stage Diln Ratio V/V | Total Diln Ratio V/V | Chill Rate C/Min | Chill Rate Corr. C/Min | Stage Temp Corr. °C. |
| 1 | 51.5 | 75 | 0.05 | 0.05 | 0.84 | 1.05 | 50.6 |
| 2 | 48.0 | 154 | 0.06 | 0.11 | 0.89 | 0.94 | 46.9 |
| 3 | 44.5 | 235 | 0.06 | 0.18 | 0.94 | 0.94 | 43.4 |
| 4 | 41.0 | 319 | 0.07 | 0.25 | 0.99 | 0.97 | 40.0 |
| 5 | 37.5 | 407 | 0.08 | 0.32 | 1.06 | 1.01 | 36.6 |
| 6 | 34.0 | 498 | 0.09 | 0.41 | 1.13 | 1.07 | 33.3 |
| 7 | 30.4 | 594 | 0.10 | 0.51 | 1.20 | 1.13 | 30.0 |
| 8 | 26.9 | 695 | 0.11 | 0.62 | 1.29 | 1.21 | 26.7 |
| 9 | 23.4 | 802 | 0.12 | 0.74 | 1.39 | 1.31 | 23.4 |
| 10 | 19.9 | 915 | 0.14 | 0.88 | 1.50 | 1.42 | 20.1 |
| 11 | 16.4 | 1035 | 0.16 | 1.04 | 1.63 | 1.55 | 16.7 |
| 12 | 12.9 | 1164 | 0.19 | 1.23 | 1.78 | 1.70 | 13.4 |
| 13 | 9.4 | 1303 | 0.22 | 1.46 | 1.96 | 1.88 | 10.0 |
| 14 | 5.9 | 1454 | 0.27 | 1.73 | 2.18 | 2.11 | 6.6 |

TABLE 1A-continued

| Stage | Stage Temp °C. | Volume Out of Stage CM3 | Stage Diln Ratio V/V | Total Diln Ratio V/V | Chill Rate C/Min | Chill Rate Corr. C/Min | Stage Temp Corr. °C. |
|---|---|---|---|---|---|---|---|
| | | Equal Temperature Drop/Stage | | | | | |
| 15 | 2.4 | 1620 | 0.33 | 2.06 | 2.44 | 2.38 | 3.2 |
| 16 | −1.1 | 1803 | 0.41 | 2.47 | 2.77 | 2.73 | −0.3 |
| 17 | −4.6 | 2010 | 0.53 | 3.00 | 3.19 | 3.18 | −3.7 |
| AVE | | | | | 1.60 | 1.56 | |
| TOTAL | | | | | | | |

TABLE 1B

| Stage | Stage Temp °C. | Solvent Out of Stage CM3 | Stage Diln Ratio V/V | Total Diln Ratio V/V | Chill Rate C/Min | Chill Rate Corr. C/Min | Stage Temp Corr. °C. |
|---|---|---|---|---|---|---|---|
| | | Equal Chilling Drop/Stage | | | | | |
| 1 | 48.7 | 138 | 0.10 | 0.10 | 1.59 | 1.99 | 47.1 |
| 2 | 42.9 | 273 | 0.11 | 0.21 | 1.59 | 1.69 | 40.9 |
| 3 | 37.6 | 403 | 0.11 | 0.32 | 1.59 | 1.60 | 35.6 |
| 4 | 32.7 | 531 | 0.12 | 0.44 | 1.59 | 1.54 | 30.9 |
| 5 | 28.3 | 655 | 0.13 | 0.57 | 1.59 | 1.51 | 26.7 |
| 6 | 24.2 | 777 | 0.14 | 0.71 | 1.59 | 1.49 | 22.8 |
| 7 | 20.5 | 897 | 0.15 | 0.86 | 1.59 | 1.47 | 19.3 |
| 8 | 17.0 | 1015 | 0.16 | 1.01 | 1.59 | 1.46 | 16.1 |
| 9 | 13.8 | 1131 | 0.17 | 1.18 | 1.59 | 1.46 | 13.2 |
| 10 | 10.8 | 1245 | 0.18 | 1.36 | 1.59 | 1.45 | 10.5 |
| 11 | 8.1 | 1357 | 0.19 | 1.55 | 1.59 | 1.45 | 8.0 |
| 12 | 5.6 | 1469 | 0.20 | 1.75 | 1.59 | 1.45 | 5.7 |
| 13 | 3.2 | 1579 | 0.22 | 1.97 | 1.59 | 1.46 | 3.5 |
| 14 | 1.0 | 1688 | 0.23 | 2.20 | 1.59 | 1.46 | 1.5 |
| 15 | −1.0 | 1796 | 0.25 | 2.45 | 1.59 | 1.46 | −0.3 |
| 16 | −2.9 | 1903 | 0.26 | 2.71 | 1.59 | 1.47 | −2.1 |
| 17 | −4.6 | 2009 | 0.28 | 3.00 | 1.59 | 1.48 | −3.7 |
| AVE | | | | | 1.59 | 1.52 | |
| TOTAL | | | | | | | |

The results are presented in Table 2.

TABLE 2

| % Heavy Oil Added | FBP/MBP °C. | | =DT PROFILE FFR $m^3/m^2.d$ | =DT PROFILE L/S w/w | =CR PROFILE FFR $m^3/m^2.d$ | =CR PROFILE L/S w/w |
|---|---|---|---|---|---|---|
| 0 | 594.7 | 491.7 | 6.37 | 4.75 | 5.97 | 4.86 |
| 2.5 | 604.8 | 493.6 | 5.72 | 4.94 | 5.32 | 4.88 |
| 5.0 | 611.4 | 496.1 | 4.97 | 5.22 | 5.01 | 5.07 |
| 10.0 | 616 | 498.0 | 4.40 | 5.52 | 4.80 | 5.29 |

The =DT profile gave a higher feed filter rate (FFR) than the =CR profile on the 594.7° and 604.8° C. Final Boiling Point (FBP) feed with performance being essential equal for the 5% added heavy oil sample (611.4° C. sample). For the 616° C. sample a higher FFR was obtained using the =CR profile as compared to the =DT profile. All samples had Mean Boiling Points (MBP) in the same general range.

EXAMPLE 2

A series of lab DILCHILL runs was performed as described in Example 1 using real plant feeds as waxy oil samples.

The results are presented in Table 3 below:

TABLE 3

| ID | FBP °C. | MBP °C. | ST DEV °C. | SKEW | KURT | =DT PROFILE FFR $m^3/m^2.d$ | =DT PROFILE L/S w/w | =CR PROFILE FFR $m^3/m^2.d$ | =CR PROFILE L/S w/w |
|---|---|---|---|---|---|---|---|---|---|
| A | 594.7 | 491.7 | 36.1 | .096 | .310 | 6.37 | 4.75 | 5.97 | 4.86 |
| B(1) | 569.2 | 488.7 | 29.9 | −.057 | .016 | 8.63 | 3.97 | 7.72 | 4.47 |
| C(2) | 585.9 | 489.7 | 33.4 | .015 | .326 | 6.38 | 4.63 | 6.03 | 4.85 |
| D(3) | 575.6 | 488.8 | 31.3 | −.047 | .176 | 7.28 | 4.56 | 6.44 | 4.52 |
| E | 602.3 | 494.5 | 39.0 | −.046 | .306 | 5.56 | 4.62 | 5.85 | 4.50 |
| F | 611.3 | 500.9 | 42.5 | −.061 | .131 | 4.60 | 4.76 | 5.25 | 4.57 |
| G | 608.1 | 501.6 | 41.5 | −.034 | .485 | 4.94 | 4.56 | 5.78 | 4.32 |
| H | 615.1 | 497.8 | 46.1 | −.26 | .56 | 4.20 | 5.50 | 4.34 | 5.50 |
| I | 614.8 | 499.2 | 46.0 | −.27 | .42 | 3.70 | 5.20 | 4.40 | 4.50 |

(1)5-95% HIVAC A
(2)D9042/D90O40, A/B
(3)D9042/D92040, 20/80 blend A/B

Figure 2:
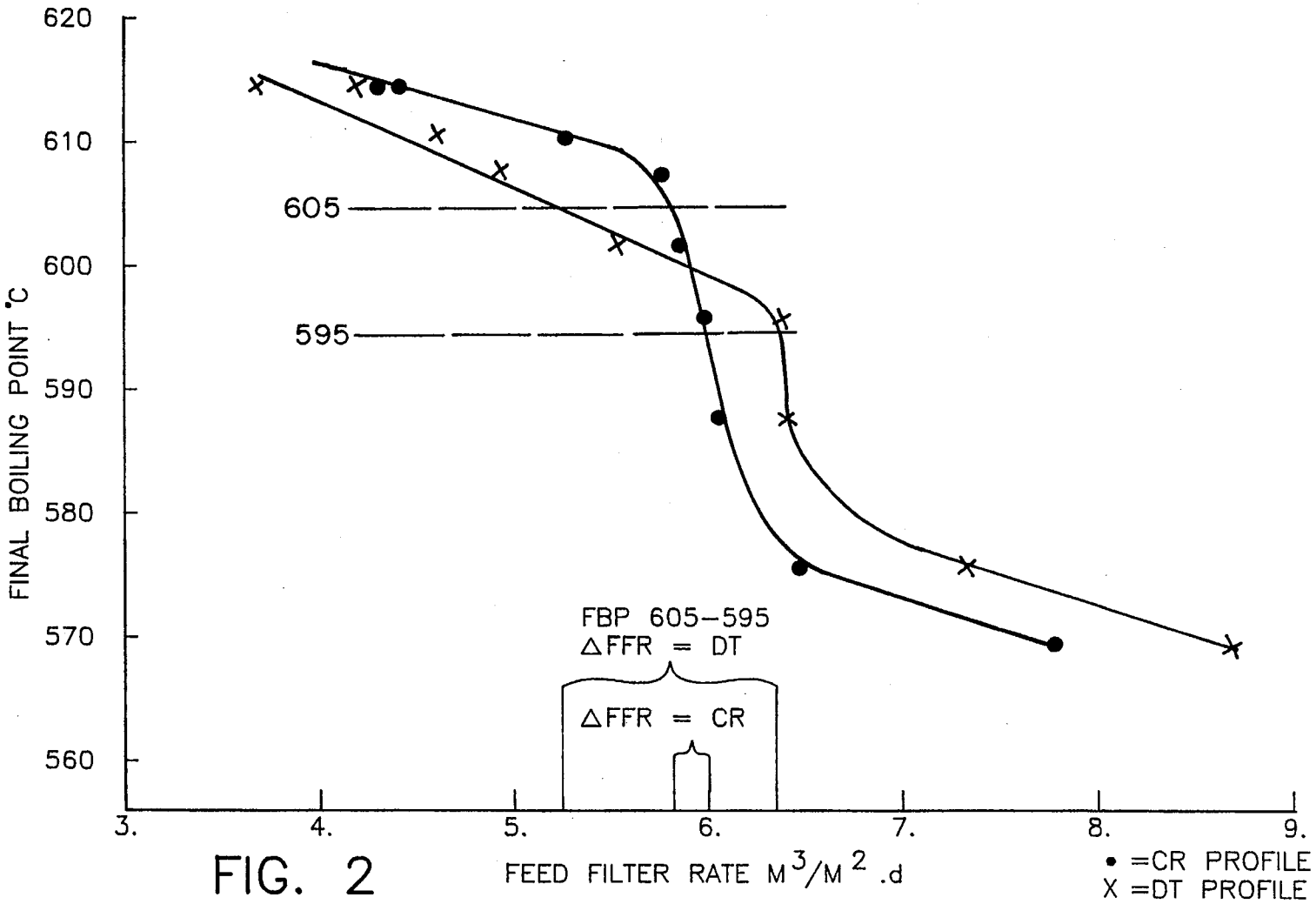
FIG. 2 correlates the feed filter rate and the feed final boiling point for equal chilling rate and equal temperature drop profiles.

As seen in FIG. 2, the change in feed filter rate (FFR) due to changing FBP is non-linear for both profiles and does not lend itself to simple linear regression. The data appear to represent two distinct straight line correlations which are disjointed in the 580° to 605° C. FBP range, possibly due to a high degree of interaction. Only the raw data is shown. The raw data plotted in FIG. 2 do show that for feeds with FPBs above ~600° C. the =CR profile gave higher FFRs than the =DT profile while the opposite was true for feeds with FBPs below ~600° C. It also indicated that reducing the FBP from 605° C. to 595° C. would lead to a significant FFR increase when using the =DT profile while the FFR increase using the =CR profile would be minimal.

What is claimed is:

1. A method for solvent dewaxing waxy hydrocarbon oils comprising dilution chilling the waxy hydrocarbon oil stock in a staged chilling zone wherein cold dewaxing solvent is injected into said zone at a plurality of the stages therealong and wherein the cold dewaxing solvent and the waxy hydrocarbon oil are substantially instantaneously mixed in each stage as the waxy oil-solvent mixture passes from stage to stage, wherein the temperature profile along said zone is adjusted such that when the waxy hydrocarbon oil is a 600N waxy oil having a final boiling point of >600° C. and a mean boiling point of about 490°-510° C. the profile is an equal chilling rate/stage profile in the staged chilling zone and when the waxy hydrocarbon oil is a 600N waxy oil having a final boiling point of <600° C. and a mean boiling point of about 490°-510° C. the profile is an equal temperature drop/stage profile in the staged chilling zone.

2. The method of claim 1 wherein the equal chilling rate/stage profile is practiced when the 600N waxy oil has a final boiling point of >605° C.

3. The method of claim 1 wherein the equal temperature drop/stage profile is practiced when the 600N waxy oil has a final boiling point of <595° C.

4. The method of claim 1 wherein the equal chilling rate/stage profile is practiced when the 600N waxy oil has a final boiling point of >610° C.

5. The method of claim 1 wherein the equal temperature drop/stage profile is practiced when the 600N waxy oil has a final boiling point of <590° C.

6. The method of claim 1, 2 or 4 wherein the equal chilling rate/stage is a chilling rate in the range of from 1° to 3° C./stage.

7. The method of claim 6 wherein the equal chilling rate/stage is a chilling rate of about 1.5° C./stage.

8. The method of claim 1, 3 or 5 wherein the equal temperature drop/stage is a temperature drop per stage in the range of about 2° to 5° C./stage.

9. The method of claim 8 wherein the equal temperature drop/stage is a temperature drop per stage of about 3.5° C./stage.

* * * * *